US005520450A

United States Patent [19]

Colson, Jr. et al.

[11] Patent Number: 5,520,450

[45] Date of Patent: * May 28, 1996

[54] SUPPLY STATION WITH INTERNAL COMPUTER

[75] Inventors: Angus R. Colson, Jr., Jamul; Linda Pinney; Gregory J. Gruzdowich, both of Del Mar; Patrick M. Steusloff, San Diego, all of Calif.

[73] Assignee: Pyxis Corporation, San Diego, Calif.

[ * ] Notice: The portion of the term of this patent subsequent to Sep. 13, 2011, has been disclaimed.

[21] Appl. No.: 285,643

[22] Filed: Aug. 2, 1994

Related U.S. Application Data

[63] Continuation-in-part of Ser. No. 0,361, Jan. 4, 1993, Pat. No. 5,346,297.

[51] Int. Cl.[6] ..... E05B 47/00

[52] U.S. Cl. ..... 312/215; 340/825.31

[58] Field of Search ..... 312/249.11, 209, 312/215, 216, 222, 245; 221/2, 9, 92; 340/825.31

[56] References Cited

U.S. PATENT DOCUMENTS

| | | | |
|---|---|---|---|
| 4,370,006 | 1/1983 | Graef et al. | 312/215 |
| 5,014,875 | 5/1991 | McLaughlin et al. | 221/2 |
| 5,225,825 | 7/1993 | Warren | 312/215 |
| 5,314,243 | 5/1994 | McDonald et al. | 312/215 |

*Primary Examiner*—Kenneth J. Dorner
*Assistant Examiner*—Gerald A. Anderson
*Attorney, Agent, or Firm*—John J. Murphy; Murphy Law Offices

[57] ABSTRACT

A supply station with internal computer, comprising an upright cabinet having integrally connected top, bottom, side and rear cabinet panels defining a tall storage and interior dispensing cavity accessible through a front opening, a plurality of horizontally openable and lockable doors, including door frames and transparent windows, hingedly mounted at various locations over the front opening, a mechanism for locking the doors when they are closed over the front opening, at least two partitions in the cavity in spaced-apart arrangement to form a smaller sub-cavity therein, a computer, including a keyboard, for inputting coded information concerning the particular dispensable items in the cabinet needed for a patient and information as to the party entering the information that causes electrical impulses to be issued therefrom in conformance with such information, mounted in the sub-cavity and accessible through the front opening; and, door unlocking mechanism interconnected the computer and the locking mechanism for receipt of the electrical impulses from the computer to selectively unlock one or more of the doors at a particular location on the station as a function of information inputted to the station.

27 Claims, 7 Drawing Sheets

FIG. 7
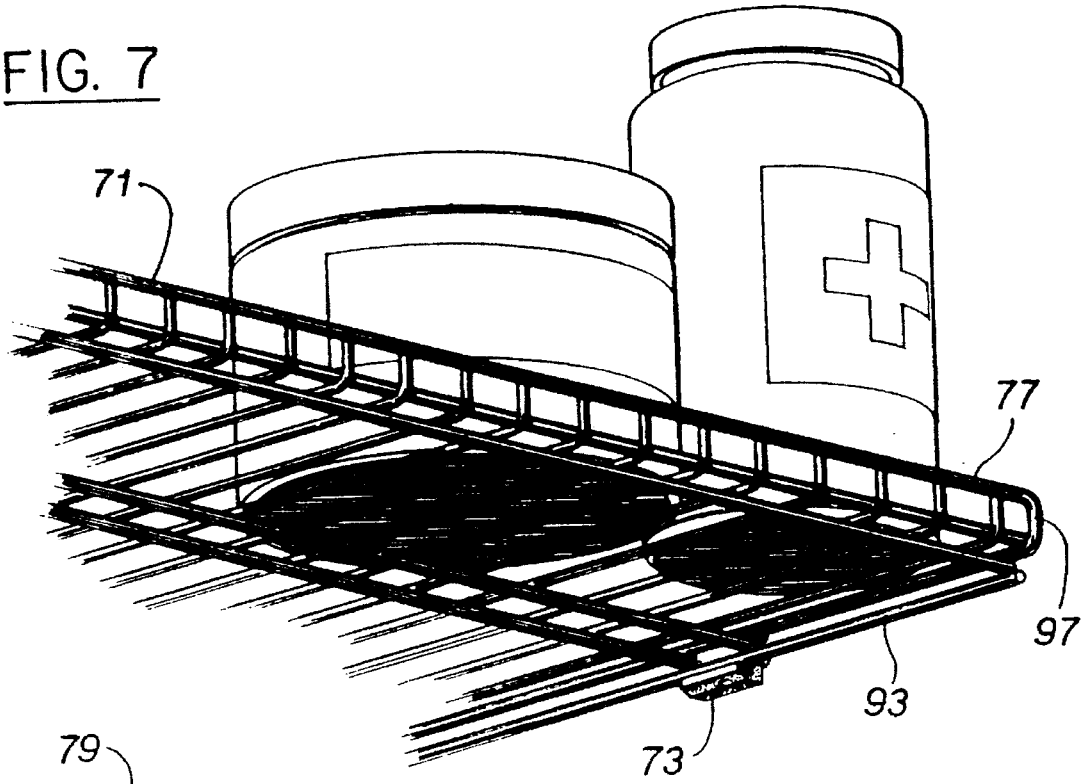
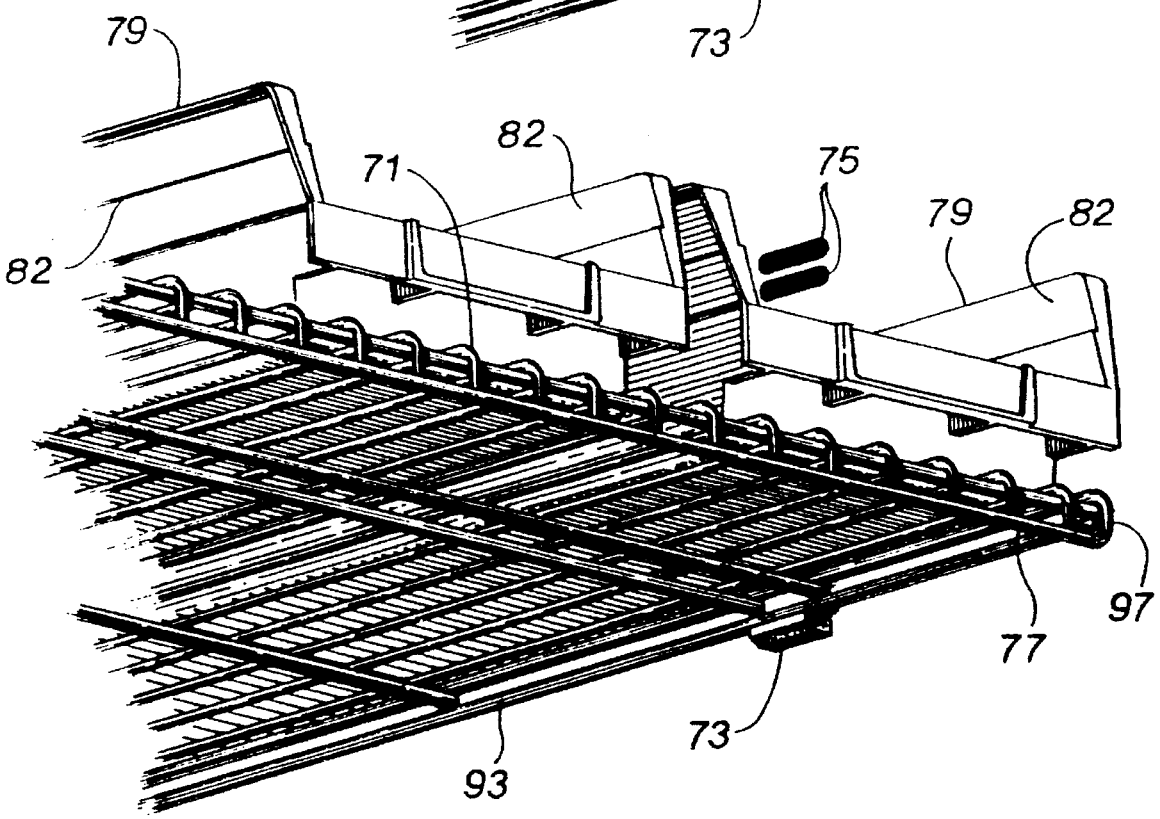
FIG. 8

SUPPLY STATION WITH INTERNAL COMPUTER

RELATION TO OTHER PATENT APPLICATIONS

This is a continuation-in-part of our previously filed application titled, "AUXILIARY STORAGE AND DISPENSING UNIT", filed Jan. 4, 1993, and given Ser. No. 08/000,361 now U.S. Pat. No. 5,346,297.

BACKGROUND OF THE INVENTION

1. Field of the Invention

This invention pertains to medication or supply dispenser stations for dispensing pharmaceutical and other supply items from locked storage in a hospital, nursing home or other environment where control of supply and inventory are of importance. More particularly, this invention pertains to a supply station having its own internal computer for controlling storage and dispensing of larger items that are not amenable to storage in conventional dispenser stations.

2. Description of the Prior Art

Dispensing items in a controlled fashion, including pharmaceutical items, one at a time, from locked storage under strict accountability and security environment is being practiced today. For instance, in many hospitals and nursing homes, medicines are now held under locked storage in medication dispenser stations, such as the one disclosed in U.S. Pat. No. 5,014,875, where nursing personnel retrieve the medicine from locked storage for dispensing, simultaneously and automatically updating the patient's records and billing. Large items, such as liter bottles of fluid, boxes of diapers, boxes of examination gloves, rolls of bandages, catheter sets and the like, are often too large to be dispensed from the patented dispensing station. Traditionally, they are stacked on open shelving where dust and dirt accumulate to interfere with the cleanliness of their use. Where they are housed in a protective layer, they are often stored on shelves over which other items are laid that have sharp corners, and are of such size and weight that the sterility seal is often compromised thereby requiring the item to be discarded without use. Moreover, these items are often stored in dark cabinets where they are soon forgotten or stored in cabinets where they are pushed out of the way during a search for other items. The end result is costly, out-of-control inventory management which adds to the expense of operation.

In addition, each hospital carries its own particular designation or stock number for dispensable items used therein. Quite often these hospital designations are different from the common name given to the item. Nursing and other technical personnel transferred from one hospital to another are frequently met with a confusing set of stock numbers and identifiers for particular items thereby providing the basis for over-ordering of some items and overlooking others. Further, these particular supplies are sometimes too bulky to be conveniently held in a small place thereby making it difficult to properly store them.

For instance, catheter units are comprised of elongated tubing that cannot be kinked or bent during storage. Without proper handling and storage, many of these items are folded over, bent or otherwise damaged so that they are no longer useful. Finally, and just as important, is the problem of putting these items to use without documentation so that they are not properly billed to the patient and their reordering is not closely controlled.

In our previous patent application, we disclosed and claimed an auxiliary storage and dispensing unit for use in combination with a separate computer-controlled supply and medication dispenser station where the station, a stand-alone unit, included a keyboard for inputting coded information concerning the particular dispensable items needed for a patient and information as to the party entering the information. These stand-alone units include drawers carrying small units of dispensable items, such as syringes, vials and the like. Industry acceptance of this combination has been strong. It has provided hospitals, nursing homes and other care facilities with a host of benefits.

For instance, inventory management has been greatly simplified. The invention has brought on an increase in security of high-cost items. Inventories are more accurately maintained. Floor-stock has been greatly reduced and restocking has been streamlined. Inventory "turns" have been increased thus insuring items being used prior to their expiration date and lack of items, i.e., "stockouts", have been reduced almost to the point of elimination.

There remains the need for a modular supply station configuration selectively employing an integrated computer controller within one of the stations. Depending on the particular requirements, a number of stations may be required to house the contents therein, however, one computer is sufficient to manage the entire complement of the stations. Such stations continue to require computer control to aid in overall management, such as to generate inventory reports automatically from one central location, and generate on-demand reports by patient, supply, nurse and nursing unit. However, the computer-controlled supply and medication dispenser station for dispensing syringes, vials and the like are not always needed.

SUMMARY OF THE INVENTION

This invention is a supply station having its own internal computer. It comprises a tall cabinet made of integrally connected panels that define an interior cavity accessible through a front opening. The front opening is accessed through one or more doors whose size and location along the front of the cabinet may be varied. The doors may be joined together to provide access to larger portions of the interior cavity in the case of large items stored therein. The doors always remain locked against the cabinet, only being opened on command, to allow a particular item to be removed. A pair of shelves forms a sub-cavity that is accessible through the front opening. In the sub-cavity is mounted a computer and keyboard for inputting coded information about the patient and the inputting personnel. The computer will cause electrical impulses to be generated or issued in conformance with the inputted information that will unlock a door or doors in the supply station to allow access to the interior cavity for withdrawal of the necessary items to treat the patient.

The interior cavity may be further modified to additional different sized, sub-cavities for storage of a variety of items by the use of shelves and bins. The doors are interconnectable to allow the user to reach different sized sub-cavities for holding different sized dispensable items. The doors are hinged on only one side of the cabinet and these hinges may be relocated to the opposite side so that they can be opened from either side depending upon the desires of the user. Racks are positionable within the storage cavity on which to hang elongated items of the type that cannot be contained in smaller packages and/or that cannot be subject to severe bending or kinking operations during storage.

The supply station of this invention is further of a type amenable to removably house a refrigerator for chilled storage of items which need to be dispensed, such as certain medicines and medicinal materials that require cooling during storage to prolong their useful life. Electrical lines are provided in the cabinet and may be interconnected with the computer to provide local illumination to a specific portion of the storage cavity to direct the user to a particular area and reduce the amount of searching and movement of other items when looking for a particular item. Wheels may be fixed to the bottom of the cabinet to allow it to be moved about and arranged in the most efficient manner to the needs or desires of the user. More than one cabinet may be arranged to operate with a single internal computer. An emergency panel is provided for access to the unlocking mechanism during power failures to allow manual unlocking of the doors and access to the interior of the cabinet.

Accordingly, the main object of this invention is a supply station with an internal computer wherein the storage cavity defined within the cabinet is accessible through one or more doors that are interconnected with the computer for selectively unlocking one or more of them at a particular location as a function of information inputted to the computer. Other objects of the invention include a medication supply station that is easily modifiable to permit access through doors opening from either side of the front of the cabinet, to interconnect one or more of the doors to provide access to a larger portion of the interior cavity for extracting large items that cannot be easily folded while retaining the lockability of the doors, and to reverse the doors' position to open from one side of the cabinet or the other to provide a wide range of on-site modification available to the user.

Still other objects of the invention include a supply station cabinet having moveable partitions therein to divide the interior storage cavity into smaller sub-cavities for storage and dispensing of smaller items; a supply station that includes racks mountable from the underside of the shelves and from the top cabinet panel for hanging dispensable items therefrom that cannot otherwise be conveniently stored; a supply station that will conveniently house a refrigerator in said cavity for chilled storage of dispensable items; and, a supply station having electrical lighting energized in particular to the area of the cavity wherein a particular item is stored.

The result, in using such an invention by hospital and nursing home personnel, is that data management is improved, processing is permitted on all billing and inventory information in real-time for accurate reporting, generation of inventory reports is made automatically from one central location, time-consuming stock-outs are avoided, billing and charting duties are minimized, requisition forms are virtually eliminated, time is reduced on reconciling discrepancies and more time is provided for patient care. Even further, use of this invention provides up-to-the minute information, allows one to track supply usage and analyze costs, assures accountability through audit trails and provides date for projections and long-term planning.

These and other objects of the invention may be determined by reading the following description of the preferred embodiment taken together with the drawings appended hereto. The scope of protection sought by the inventors may be gleaned from a close reading of the claims that conclude this specification.

DESCRIPTION OF THE DRAWINGS

FIG. 7 is a trimetric view of a portion of a wire shelf with the front edge turned up;

FIG. 8 is the same view as in FIG. 7, with the wire shelf having the front edge turned down;

DESCRIPTION OF THE PREFERRED EMBODIMENT

Figure 1:
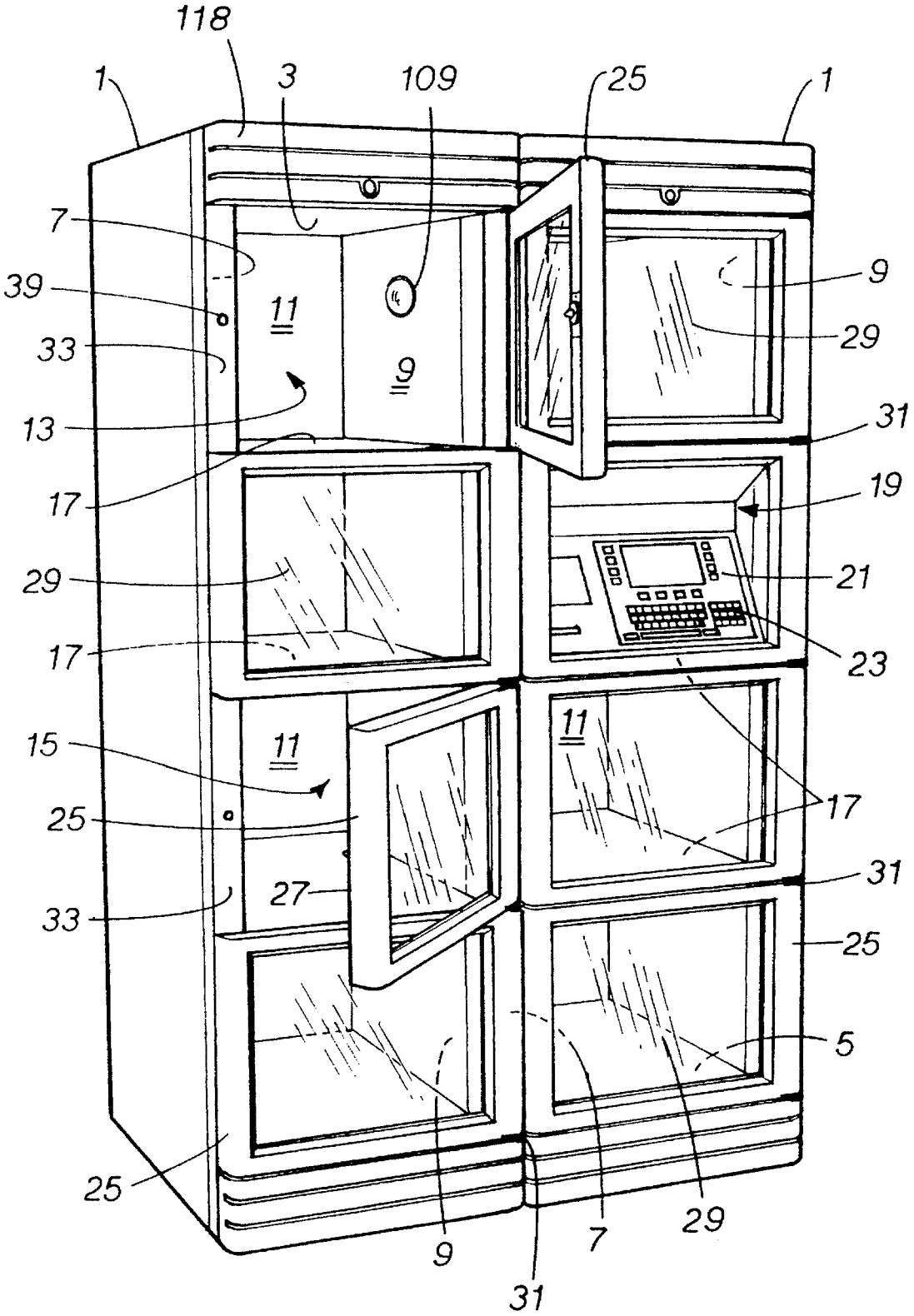
FIG. 1 is an illustrative view of the preferred embodiment of the supply station of this invention showing the cabinet to be divided into sub-cavities by a plurality of partitions or shelves.

Referring to the drawings wherein like numerals identify like elements throughout the fourteen drawings, the invention is shown to comprise a tall, upright cabinet 1 made up of spaced-apart top and bottom panel members 3 and 5, respectively, joined about three of their marginal edges by spaced-apart side panels 7 and 9, respectively, and a rear cabinet panel 11 integrally connected along their mutually adjacent marginal edges, such as by welding or other secure fastening. As shown, panels 3 through 11 define an interior dispensing cavity 13 accessible through a front opening 15 that is defined by the respective edges of top and bottom panels 3 and 5 and side panels 7 and 9.

A pair of partitions 17 is shown in spaced-apart arrangement in cavity 13 to form a subcavity 19 wherein a computer 21, including a computer and computer accessories such as a keyboard 23 and optionally, a display means, a mouse device, and an output device such as a printer are mounted therein. The display means includes liquid crystal displays (LCD), cathode ray tubes (CRT), gas plasma displays, and/or dedicated visual indication devices such as light emitting diodes (LED).

Figure 2:
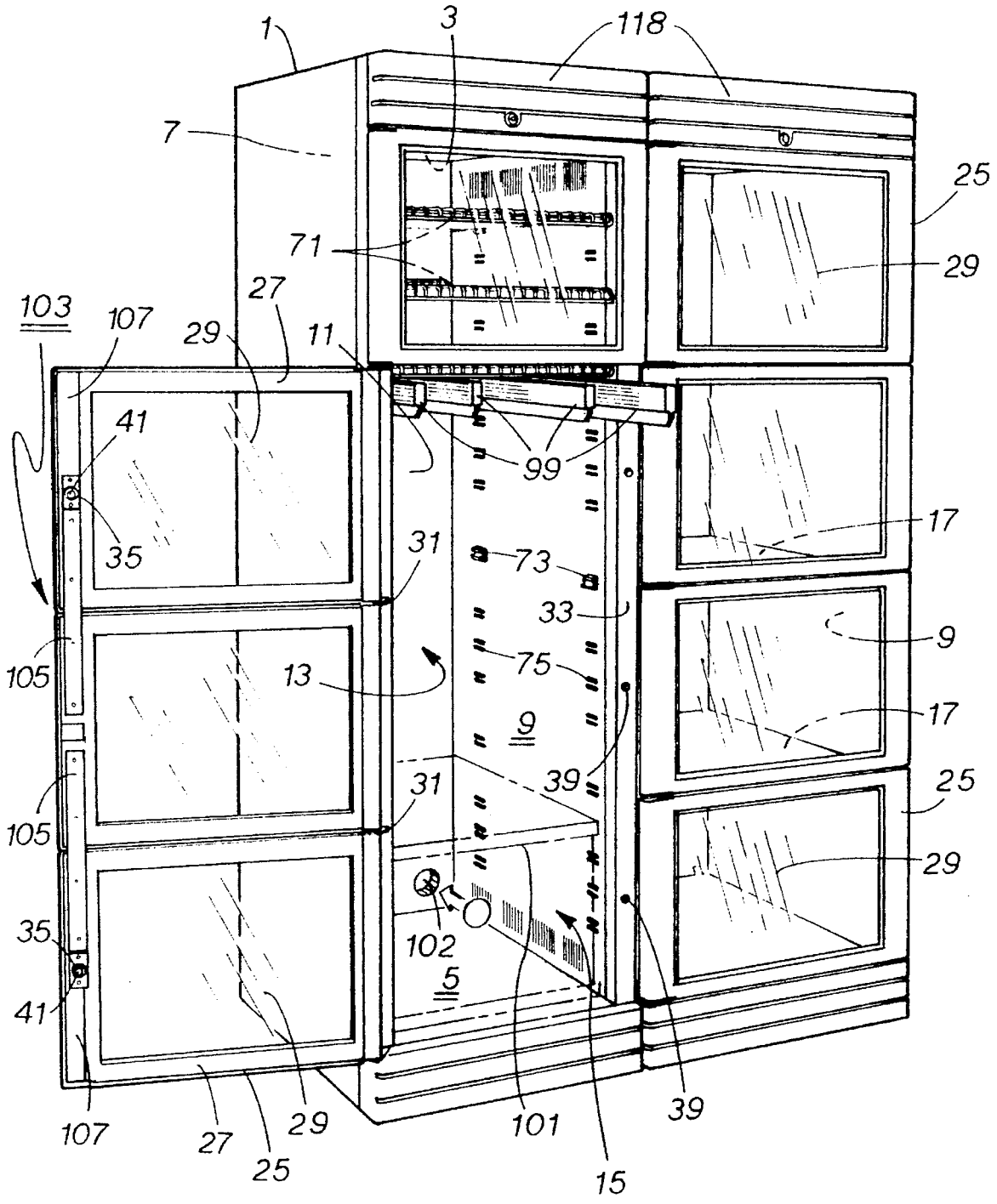
FIG. 2 is an illustrative view of the embodiment shown in FIG. 1 showing certain of the doors to be interconnected and opening from the opposite side and sliding hanger units positioned at the top of the enlarged interior cavity.
Figure 3:
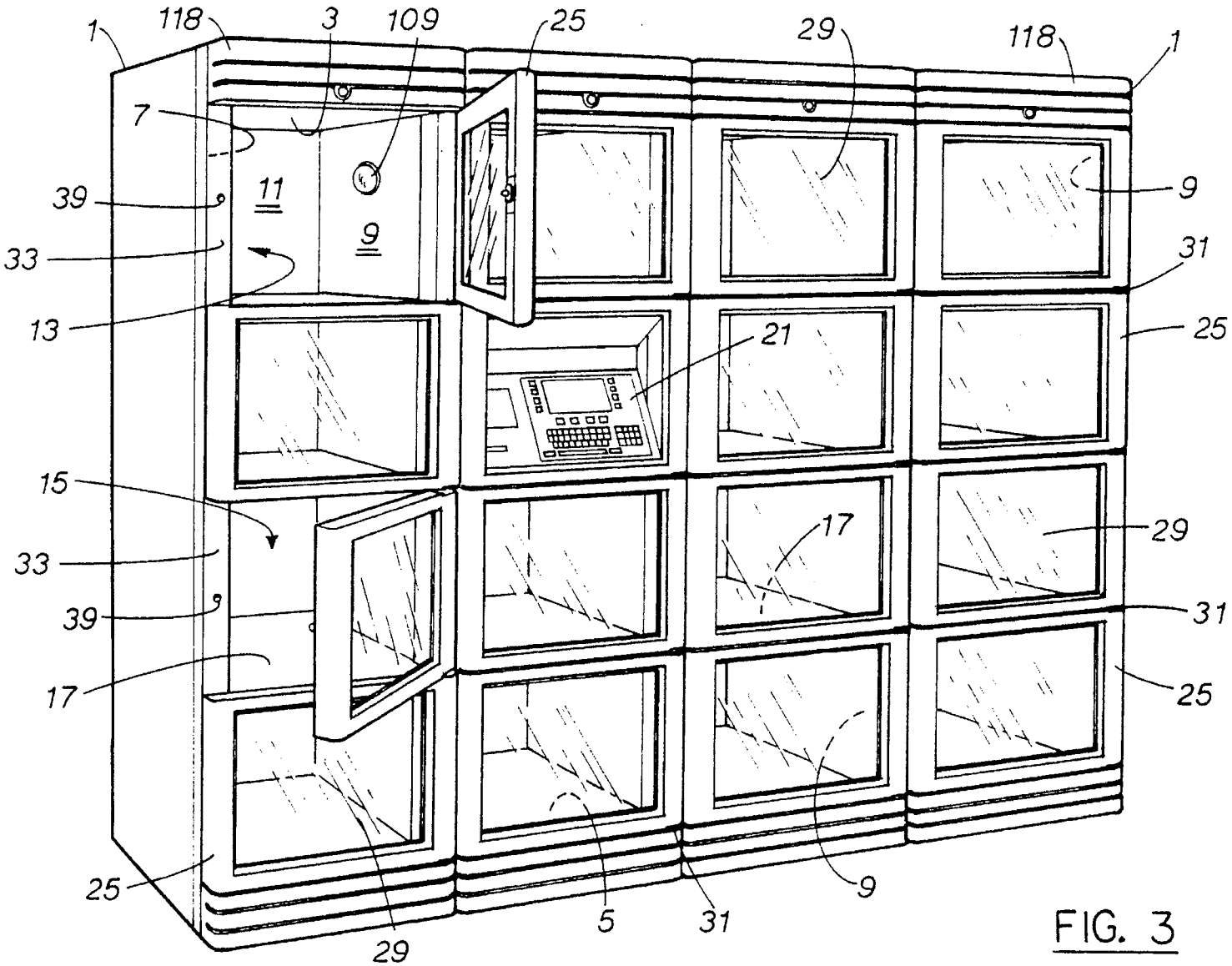
FIG. 3 is an illustrative view of a plurality of supply stations interconnected to operate from one computer.

As shown in FIGS. 1 and 2, a plurality of doors 25, each comprising an integral door frame 27 surrounding a transparent window 29 is pivotally mounted by hinges 31 attached to the front edge 33 of side panel 7 or 9 to be openable and closeable over cavity 13 by a latch 35 (see also FIG. 4), located on one or more doors 25 that is received in a locking/unlocking means 37 (see FIGS. 5, 9 and 12), mounted behind an aperture 39 in side panel 9.

Figure 5:
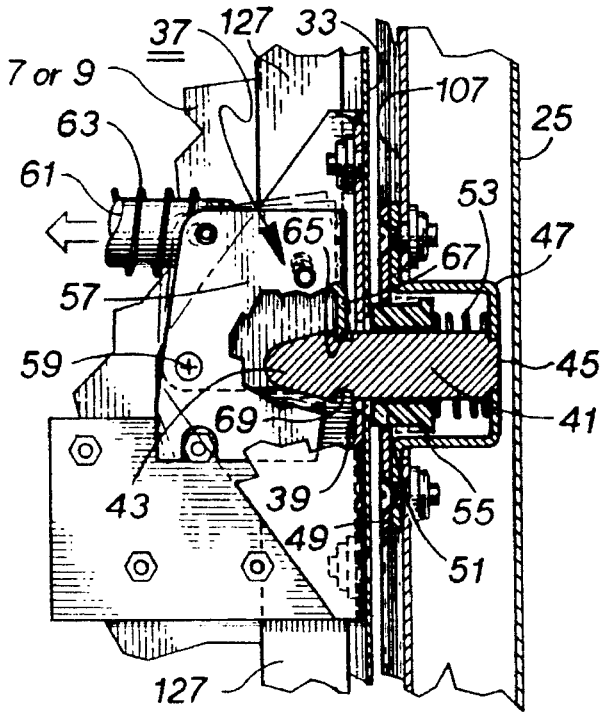
FIG. 5 is a side elevational view, partly in section, of the door latch taken along lines 5—5 in FIG. 4.
Figure 4:
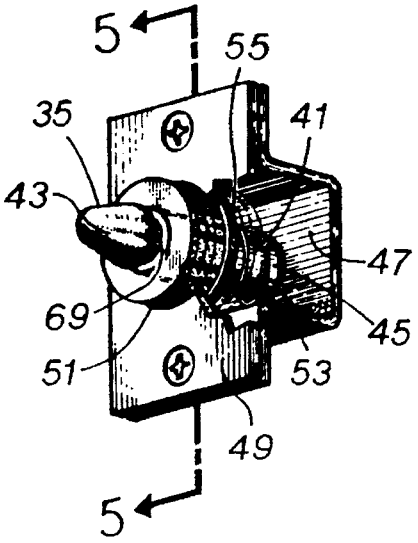
FIG. 4 is a trimetric view of the door catch assembly ready to be mounted in a door of the cabinet.

As shown in FIGS. 4 and 5, latch 35 comprises a solid bolt 41 having a conically pointed latching end 43 and an opposite base end 45 that is mounted against a wall 47 making up a frame 49. A sleeve 51 is reciprocally mounted over bolt 41 biased outward towards latching end 43 by a spring 53, and restrained from further motion by a stop collar 55 mounted on sleeve 51.

Figure 12:
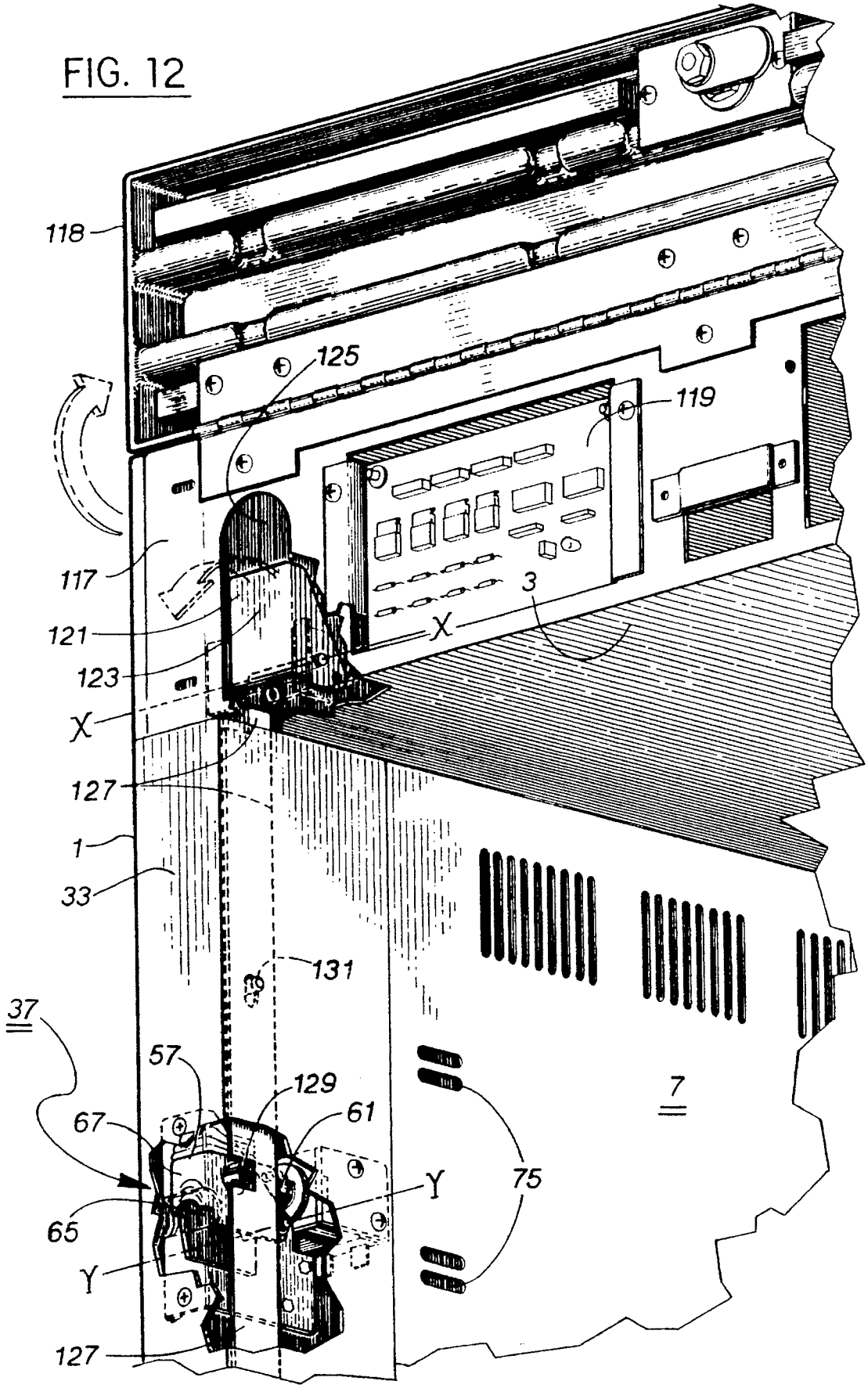

As further shown in FIGS. 5 and 12, locking/unlocking means 37 comprises a bracket 57 pivotally mounted by a shaft 59 attached to a pull rod 61 that is biased forward by a spring 63. A notch 65 is formed in bracket 57, aligned with bolt 41 to allow insertion of conically pointed bolt latching end 43. As door 25 is closed, bolt 41 enters notch 65 and is temporarily captured therein by a latch plate 67 on bracket 57 that drops down behind conical latching end 43 into a groove 69 formed about the base of end 43. Simultaneously, sleeve 51 is pushed backward into frame 49 and against the bias pressure from spring 53.

The user, nursing or technical person, may input to keyboard 23 coded information concerning the particular patient and information as to the person entering the data. Computer 21 will cause electrical impulses to be issued that will travel through cables (not shown) to actuate a particular electric solenoid located inside panel 7 (not shown) to allow a particular door 25 to unlock by pulling on pull rod 61 to lift latch plate 67 and allow sleeve spring 53 to push 28 the door partially open to permit access to the interior of cabinet 1 and simultaneously and automatically update the patient's record, billing and hospital inventory. The data may be displayed on a display (not shown) or printed on a sheet of paper by a printer (not shown) that is part of the computer.

As shown in FIGS. 2, and 7–9, a plurality of wire shelves 71 or partitions 17 are insertable and mountable in spaced-apart pairs of slide fittings 73 inserted in slot 75 inside cabinet cavity 13 on each side thereof to permit cavity 13 to be divided into a plurality of sub-cavities either of the same size or of a variety of sizes depending upon the requirements of the particular dispensable item to be stored therein. Shelves 71 may have an upwardly or downwardly turned front edge 77 to either prevent items from slipping forward and out of the sub-cavity during loading and/or dispensing, or to prevent a bin 79 below on the next shelf from falling out of cavity 13 (see FIG. 9).

Figure 9:
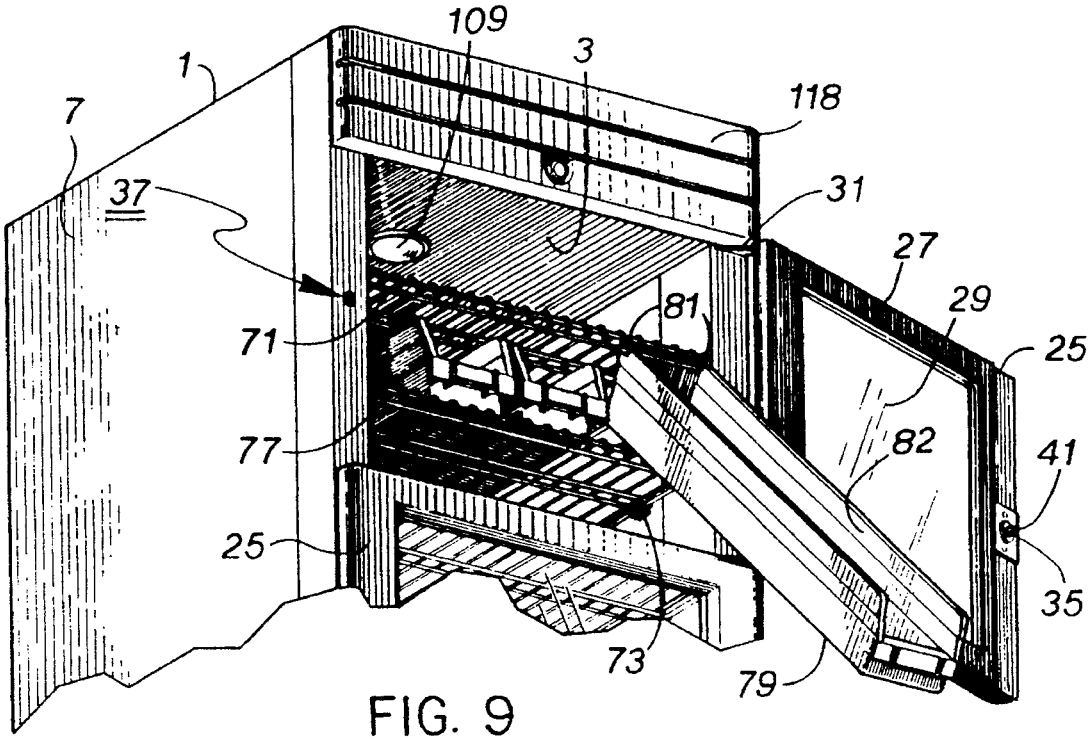
FIG. 9 is a trimetric view of a portion of the front of the cabinet with a storage bin pulled out and then rotated downward into an access hold position.
Figure 10:
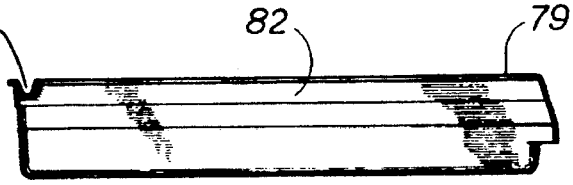
FIG. 10 is a side elevational view of the storage bin shown in FIG. 3.

FIG. 7 shows how an upwardly turned front edge is used to prevent items from falling out of the cabinet while FIGS. 9 and 10 show how a notch 81, formed at the upper rear of bin side walls 82 can lock with the downwardly turned edge 77 to keep from falling out of the cabinet.

It is preferred that each shelf have one upwardly turned edge 77 and a downwardly turned edge 77 in mutually opposed spaced-apart arrangement. In this manner, to change from one to the other, requires only the shelf to be removed from cabinet interior cavity 13, rotated in a horizontal plane 180° and put back into said cavity. When the shelf is placed in the cabinet to have its upwardly turned edge at the front, the downwardly turned edge will be at the rear thereof.

Figure 6A:
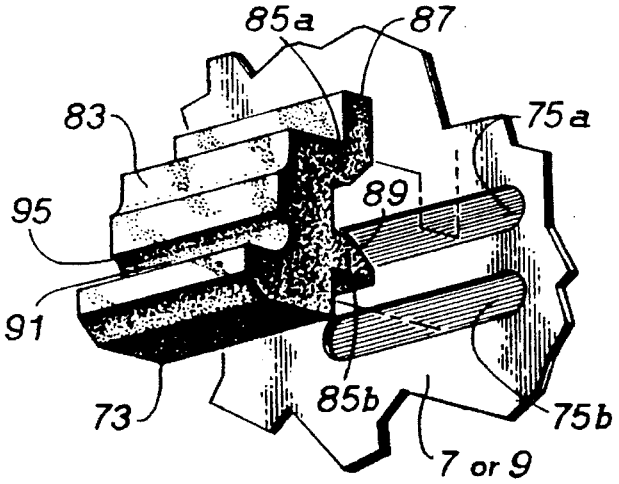
FIGS. 6*a*, 6*b* and 6*c* are trimetric views of a portion of the inside side wall of the cabinet showing the shelf bracket in assembly sequence and contacted by the shelf as it is being pulled forward.
Figure 6B:
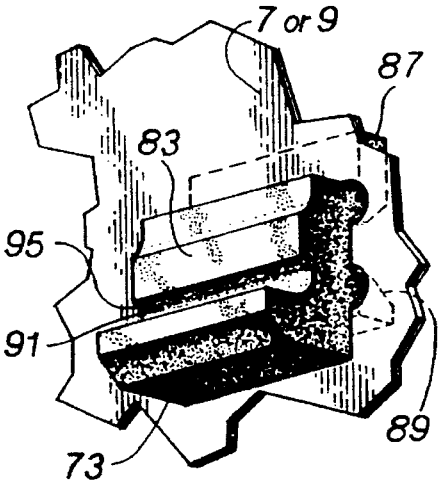

Further, as shown in FIGS. 7 and 8, shelves 71 may be of the variety that can be moved inward and outward such as on slide fittings from cavity 13 to facilitate placement of items for storage and removal of dispensable items. With respect to slide fittings 73, the preferred embodiment is shown in FIGS. 6*a* and 6*b* to comprise a body 83 and a pair of spaced-apart first and second mounting legs 85*a* and 85*b* extending therefrom respectively that are received in parallel slots 75*a* and 75*b*. First leg 85*a* includes an upwardly turned portion 87 adapted to bear against the inside of cabinet side panel 7 or 9, depending upon which side panel it is mounted, and second leg 85*b* contains a bevelled surface 89 to assist in inserting fitting 73 in slots 75*a* and 75*b*. A shelf-carrying groove 91 is formed in body 83, opposite from legs 85*a* and 85*b*, for supporting the lower rail or wire 93 forming the horizontal edge of shelf 71 (see FIGS. 6*c*, 7 and 8).

Figure 6C:
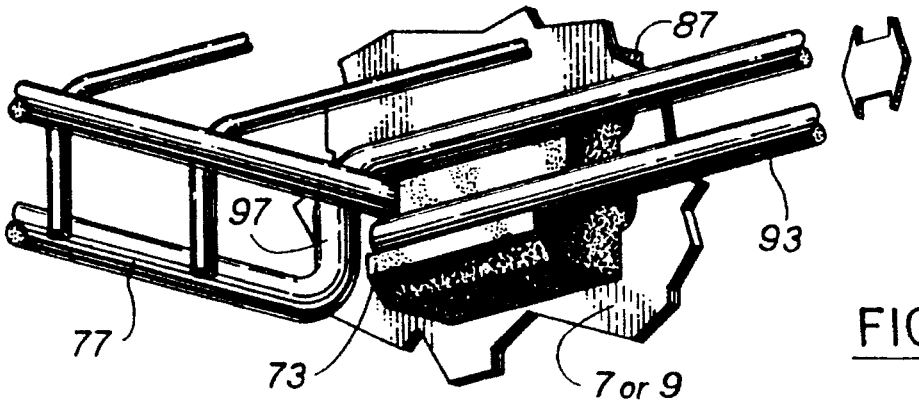

An inwardly directed groove wall segment 95 is formed in groove 91, above the lower half of groove 91, for bearing against the upper surface of lower rail 93 to prevent the shelf from tilting upward in the rear as shelf 71 is pulled out along groove 91 to expose items stored thereon. As shown in FIG. 6*c*, a vertical post 97 is formed at the rear of shelf 91 and arranged at the side there of to abut the rear-most slide fitting 73 after it is pulled forward out of cavity 13 to prevent said shelf from being pulled completely out of said cavity during normal use thereof. Should it be desired to remove shelf 41 completely from cavity 13 and relocate it elsewhere at said cavity, the shelf is pulled forward until post 97 abuts fitting 73, then side panel 7 (or 9) is temporarily distorted outward (called "oil canning") to allow the shelf to clear fitting 73 and be totally removed from cavity 13. Fittings 73 are then removed from slots 75 and relocated elsewhere in side walls 7 and 9 to thereafter receive shelf 71 therein.

A plurality of extensible racks 99 are provided, as shown in FIG. 2, for mounting on the underside of a shelf 71 to be pulled forward out of cavity 13 for hanging dispensable items therefrom such as intravenous and catheter units and then to be moved back inside cavity 13 for storage. Other forms of tall items may be conveniently stored in this upwardly elongated sub-cavity such as crutches, packages of stacked facial tissue and the like. Racks 99 may also be mountable on the underside of top panel 3 as well to provide a substantially larger elongated cavity for storage.

Shown in dotted outline in FIG. 2 is a small electric refrigerator 101 is preferably stored in the lower portion of cabinet cavity 13 to retain therein, in chilled storage, certain dispensable items such as medicines and the like whose storage requires lower temperature. The gradual upward flow of warm, dry air from the refrigerator's exterior-mounted heat exchanger through cavity 13 helps retain the items stored therein at a relatively low humidity. This also appears to help keep dust from entering the cavity thus retaining the stored items substantially free of contaminants. The electric cord used to connect refrigerator 101 to an external power source may be passed out through a pluggable opening 102 formed in rear cabinet wall 11 as shown in FIG. 1. In addition, the pluggable opening 102 may be employed to pass through the cords and cables associated with the on board computer 21.

Means 103 is provided for interconnecting one or more doors 25 to provide access to a larger sub-cavity than is possible by a single door, to store and to dispense elongated items such as catheters and crutches. As shown in FIG. 2, means 103 preferably includes one or more elongated metal or other hard straps 105 inserted and bolted, screwed or otherwise affixed in the rear face 107 of door frame 27 spanning two adjacent doors, to interconnect them and allow the interconnected doors to be opened and closed as one complete unit. In such a configuration, locking/unlocking means 37 may comprise only one, a few, or all of the unlocking solenoids and hardware associated with each individual door. Where only one locking and unlocking means 37 is employed, computer 21 must be programmed to allow access to the interconnected doors by disengaging the unlocking electrical solenoid for the other door or doors. Where the locking/unlocking mechanisms for each door are to be employed, computer 21 must be programmed to actuate the solenoids for each of the doors in unison to allow simultaneous unlocking of all of them.

In the preferred embodiment, the subcavity housing the computer 21 is fitted with a doorless bezel to allow unrestricted access to the computer. The bezel to closely resemble and match the esthetic appearance and configuration of the station and its doors. In another configuration, the station does not employ a locking means 37 for the subcavity housing the onboard computer, thereby providing unrestricted access to the computer and its accessories.

As shown in FIG. 2, interior cavity 13 may be divided by a combination of interconnecting some of the doors to provide upwardly elongated storage sub-cavities for storing elongated items therein, while at the same time providing smaller sub-cavities for storage of substantially smaller items thereabove or therebelow.

As shown in FIGS. 1 and 2, doors 25 may be arranged to open from different sides of cabinet 1. This is preferably accomplished by arranging hinges 31 and locking/unlocking means 37 to be fully interchangeable so that doors 25 may be reversed 180° to thereafter be hinged on the opposite side of cabinet 1 and the door used in an "upside down" configuration. Door frame 27 is conveniently made with consistent measurements top and bottom and from side-to-side so that reversing it poses no problem to the operation of the cabinet. While not specifically shown, a plurality of cabinets 1 may be utilized and interconnected with one particular supply station through cables (not shown) and provide various sized sub-cavities within each cavity for the storage of dispensable items. Through the use of adjustable shelves 71 and the ability to make doors 25 open from one side or the other, in combination with means 103 for joining specific doors in a unitary door combination, this invention is capable of a wide range of storage and dispensing configurations.

Electrical lighting is provided interior of cabinet 1. As shown in FIGS. 1 and 9, a series of individual electric lamps 109 is placed throughout cavities 13, in panels 3–11, for illuminating the items stored therein. To aid the user, the information inputted to keyboard 23 on computer 21 may be programmed to cause not only the appropriate door to unlock for opening, but also the appropriate lamp or lamps in the sub-cavity to illuminate wherein the dispensable items are stored. This feature reduces the amount of searching by the user and promotes efficiency in the use of the supply station. It also helps the user locate items that may be carried under an unfamiliar stock number or other identifier code.

Figure 11:
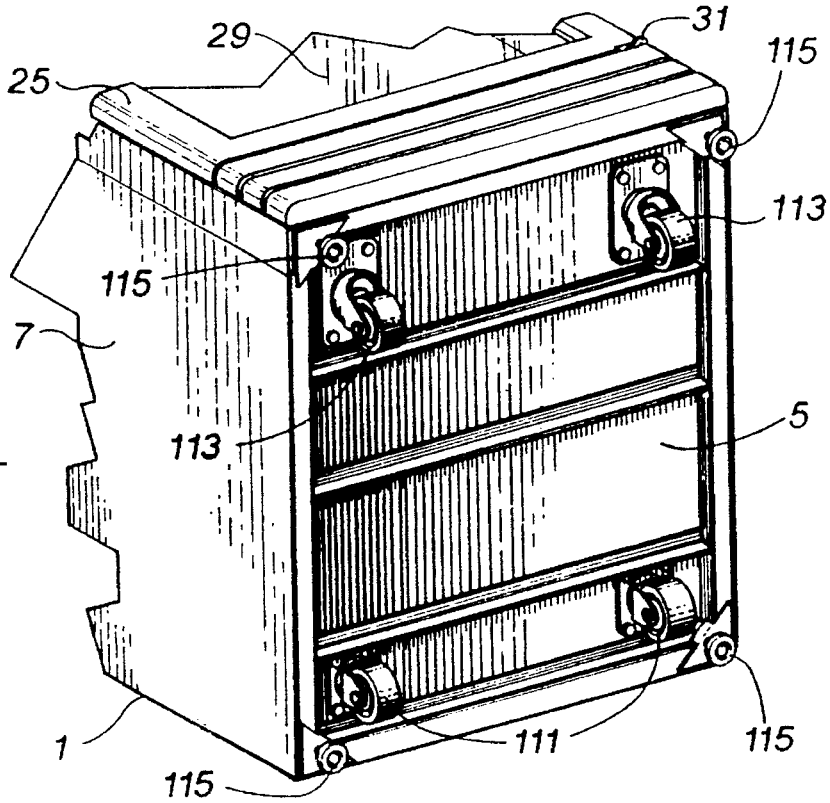
FIG. 11 is a trimetric view of the bottom of the cabinet showing fixed and swivel casters and levelling pads; and, FIG. 12 is a trimetric view of a portion of the front of the cabinet showing the manual door unlock system, with cutaways for clarity.

As shown in FIG. 11, a pair of fixed wheels 111 and a pair of casters 113 are mounted under cabinet 1 for aid in positioning it. Adjustable leveling mechanisms 115 are also mounted under cabinet 1, in the corners thereof, to aid in leveling the station.

As shown in FIG. 12, an emergency access panel 117 is mounted at the top front of cabinet 1, covered over by a liftable, locked cover plate 118 that may be unlocked and raised to expose the electronic control circuit board 119 and the emergency door opening mechanism 121, the latter usable in the event of a total loss of electrical power to supply cabinet 1 or a malfunction in keyboard 23 or its related components. Door opening mechanism 121 comprises a handle 123 pivotally mounted along an axis x—x in a cubbyhole 125 formed in access panel 117 connected to an elongated strap 127 slidably mounted inside panel front edge 33 with strap slide pins 131 and extending down inside cabinet side panel 7 or 9. Strap 127 has openings formed therein that align with and are larger than reversible pins 129 that are connected to the inside face of brackets 57 in means 37. Strap 127 has a notch formed therein closely located about an actuating pin 129 affixed to each bracket 57. As handle 123 is pulled downward, in the direction of the arrow in FIG. 12, strap 127 is moved upward thereby lifting and rotating brackets 57 about an axis y—y in unison so that the individual latch plates 67 are raised from grooves 69 to allow each door to be opened. The spring bias on sleeve 51 quickly moves outward against panel front edge 33 to partially move the doors through an arc and away from front edge 33.

While the invention has been described with reference to a particular embodiment thereof, those skilled in the art will be able to make various modifications to the described embodiment of this invention without departing from the true spirit and scope thereof. It is intended that all combinations of elements and steps which perform substantially the same function in substantially the same way to achieve substantially the same results are within the scope of this invention.

What is claimed is:

1. A supply station with internal computer, comprising:

a) an upright cabinet having integrally connected top, bottom, side and rear cabinet panels defining a tall storage and interior dispensing cavity accessible through a front opening;

b) a plurality of horizontally openable and lockable doors, including door frames and transparent windows, hingedly mounted at various locations over said front opening;

c) means for locking said doors when said doors are closed over said front opening;

d) a computer, including a keyboard, for inputting coded information concerning the particular supply in said cabinet needed for a patient and information as to the identification of the person entering the information in said keyboard that causes electrical impulses to be issued therefrom in conformance with such information, mounted in said cabinet; and, e) door unlocking means interconnected said computer and said locking means for receipt of said electrical impulses from said computer to selectively unlock one or more of said doors at a particular location on said station as a function of information inputted to said station.

2. The supply station of claim 1 wherein said computer, including said keyboard, for inputting coded information concerning the particular supply in said cabinet needed for a patient and information as to the identification of the person entering the information in said keyboard that causes electrical impulses to be issued therefrom in conformance with such information, is mounted in said cabinet.

3. The supply station of claim 1 further including a display means on which such coded information is displayed upon command.

4. The supply station of claim 1 further including at least two partitions in said cavity in spaced-apart arrangement to form a smaller sub-cavity therein.

5. The supply station of claim 4 further including a closable door hingedly mounted over said sub-cavity.

6. The supply station of claim 5 wherein said door is lockable.

7. The supply station of claim 5 wherein said display means includes a liquid crystal display.

8. The supply station of claim 5 wherein said display means includes a gas plasma display.

9. The supply station of claim 5 wherein said display means includes a light emitting diode.

10. The supply station of claim 5 wherein said display means includes a cathode ray tube.

11. The supply station of claim 1 further including additional cabinets operated from said computer.

12. The supply station of claim 1 wherein said plurality of doors is arranged to open from one side of said cabinet.

13. The supply station of claim 1 including means for reversing the doors to open from the opposite side of said cabinet.

14. The supply station of claim 1 further including more partitions to divide said cavity into vertically smaller subcavities for storage and dispensing smaller items therefrom.

15. The supply station of claim 14 further including an upwardly turned front lip formed on said partitions to aid in retaining the items stored therein.

16. The supply station of claim 14 including a downwardly turned front lip formed on said partitions to aid in retaining the items stored therein.

17. The supply station of claim 14 wherein said partitions include an upwardly turned front lip and a downwardly turned rear lip spaced-apart therefrom so that by rotating said partition 180° said downwardly turned rear lip may be relocated to the front of said partition.

18. The supply station of claim 14 further including moveable racks mountable on the underside of said partitions for hanging dispensable items therefrom.

19. The supply station of claim 14 further including spaced-apart pairs of slide fittings interposed said partitions and said side panels wherein each said fitting comprises:

a) a fitting body;

b) a pair of spaced-apart first and second legs extending therefrom for insertion in a pair of slots formed in each said cabinet side panel;

c) said first leg having an upwardly turned portion adapted to bear against the inside of said cabinet side panel after insertion into said slot;

d) said second leg having a beveled surface formed thereon to assist in mounting said fitting in said slots;

e) a partition-carrying groove formed in said body opposite said legs for supporting said partition in sliding arrangement thereacross; and, f) an inwardly directed wall segment of said groove formed above the lower half thereof, for bearing against an upper surface of said partition to prevent said partition from tilting downward during withdrawal from said cabinet to expose items stored thereon.

20. The supply station of claim 1 further including moveable racks mountable on the underside of said top cabinet panel for hanging dispensable items therefrom.

21. The supply station of claim 1 further including a refrigerator temporarily retained in said cavity for chilled storage of dispensable items.

22. The supply station of claim 1 further including electrical lighting lamps mounted interior said cabinet and means for energizing a particular lamp to illuminate a portion of said cavity wherein the desired dispensable item is stored.

23. The supply station of claim 1 including wheels on which to move said cabinet.

24. The supply station of claim 1 further including an emergency access panel covered by a locked cover plate that may be unlocked to expose an emergency door opening mechanism for unlocking said cabinet doors in the event of a power failure.

25. The supply station of claim 1 further including means for interconnecting one or more of said doors to allow access to a particular portion of said interior cavity.

26. The supply station of claim 25 wherein said means for interconnecting one or more of said doors includes an elongated strap for insertion across said door frames of two or more adjacent doors.

27. The supply station of claim 1 wherein said door unlocking means includes an electric solenoid actuated by said electrical pulses received from said computer to selectively unlock a specific door lock as a function of information inputted to said computer.

* * * * *